United States Patent [19]

Modafferi

[11] 4,062,118

[45] Dec. 13, 1977

[54] KNIFE HAVING AN INTERCHANGEABLE BLADE

[76] Inventor: Paul Modafferi, 1601 Anderson Ave., Fort Lee, N.J. 07024

[21] Appl. No.: 703,427

[22] Filed: July 8, 1976

[51] Int. Cl.[2] ..... B26B 1/00

[52] U.S. Cl. ..... 30/339; 30/344

[58] Field of Search ..... 30/339, 344, 342, 340

[56] References Cited

U.S. PATENT DOCUMENTS

| | | | |
|---|---|---|---|
| 886,809 | 5/1908 | Howell | 30/342 X |
| 1,270,492 | 6/1918 | Cameron et al. | 30/342 X |
| 2,187,634 | 1/1940 | Soderlind | 30/344 |
| 2,291,128 | 7/1942 | Yarrow | 30/344 |
| 2,359,408 | 10/1944 | Disse | 30/339 X |
| 2,492,096 | 12/1949 | Juengst | 30/344 |
| 2,674,794 | 4/1954 | Baker | 30/344 X |
| 2,681,502 | 6/1954 | Black | 30/340 UX |
| 2,753,632 | 7/1956 | Varn | 30/342 X |
| 2,968,060 | 1/1961 | Eubanks | 30/342 X |

FOREIGN PATENT DOCUMENTS

| | | | |
|---|---|---|---|
| 242,854 | 1/1912 | Germany | 30/340 |
| 585,316 | 11/1958 | Italy | 30/344 |
| 433,259 | 8/1935 | United Kingdom | 30/339 |
| 1,275,955 | 6/1972 | United Kingdom | 30/344 |
| 151,872 | 10/1920 | United Kingdom | 30/344 |

*Primary Examiner*—Al Lawrence Smith
*Assistant Examiner*—J. T. Zatarga
*Attorney, Agent, or Firm*—Robert D. Farkas

[57] ABSTRACT

A knife having interchangeable blades comprising an elongated rigid unitary handle element having an elongated open ended chamber therein, a tapered sharpened knife blade providing a tang at one end thereof dimensioned to be captured and removably secured in the chamber, and bolt means for securing the blade in the chamber.

3 Claims, 6 Drawing Figures

KNIFE HAVING AN INTERCHANGEABLE BLADE

BACKGROUND OF THE INVENTION

1. Field of the Invention

The present invention relates to knives, and more particularly, to knives providing interchangeable blade portions.

2. Description of the Prior Art

Presently, knives with interchangeable blades provide a pair of handle elements which sandwich a knife blade and are secured together by a plurality of cylindrical studs and bolts or the like. These knives are subject to loosening and frequently the blade wedges the handle elements apart rendering the knife useless for accurate cutting.

U.S. Pat. No. 1,997,131 issued to P. T. Champlin on Apr. 9, 1935 discloses a knife including a pair of handle members joined about the tang of a blade by a threaded bolt and stud.

U.S. Pat. No. 2,467,481 issued to C. J. Huff on Apr. 19, 1949 teaches a knife having two separate handle members which is held together around the tag of a knife blade. The knife blade is also engaged by a post element provided by one of the handles to permit longitudinal movement of the blade.

The present invention overcomes the problems associated with the prior art by providing a knife with an interchangeable blade which includes a unitary handle which will not be wedged apart.

SUMMARY OF THE INVENTION

Therefore, it is a primary object of the present invention to provide a knife having an interchangeable blade which includes a handle which will not separate after heavy use.

A further object to provide a knife with a blade which may be quickly and easily removed.

Another object is to provide a knife having interchangeable blades which is simple in design, inexpensive to manufacture and durable.

These objects, as well as further objects and advantages of the present invention will become readily apparent after reading the description of a non-limiting illustrative embodiment and the accompanying drawing.

The present invention provides a knife having an interchangeable blade which is easily and quickly removed and replaced and which is extremely durable and not subject to lateral blade movement or "wobble." An elongated rigid unitary handle element provides an open-ended chamber therein. The longitudinal axis of the chamber is substantially parallel to the longitudinal axis of the handle element. A sharpened knife blade provides a tang at one end thereof which is adapted to be inserted into the open ended chamber of the handle element. When the tang is inserted into the longitudinal chamber a plurality of holes located therein align with a plurality of apertures located in the handle. After the holes and the apertures align a plurality of bolts are inserted therethrough removably securing the blade.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
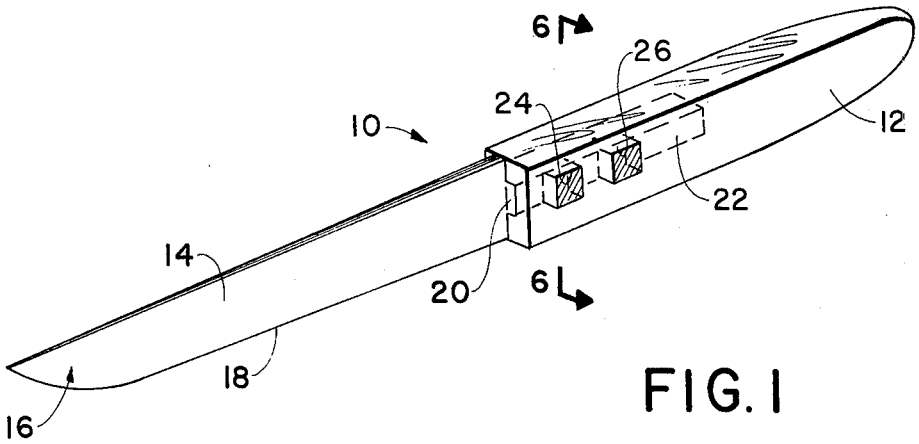
FIG. 1 is a perspective view of the preferred embodiment incorporating the principles of the present invention.

Referring now to the figures, and more particularly to FIG. 1, there is illustrated therein a knife 10 which includes an elongated rigid unitary handle element 12 and a sharpened knife blade 14. The handle element 12 is dimensioned to fit comfortably in the hand of the user and may be constructed of wood, hardened plastic, or the like. The front portion 16 of the blade 14 is tapered and the lower edge 18 thereof is sharpened to a conventional cutting edge. The blade 14 provides a tang 20 which is inserted into a open ended elongated chamber 22 located in the handle element 12. The longitudinal axis of th elongated chamber 22 is substantially parallel to the longitudinal axis of the handle element 12. A pair of substantially rectangular apertures 24 and 26 are disposed through the handle element 12. The longitudinal axis of the apertures 24 and 26 are transverse to the longitudinal axis of the handle element 12.

Figure 2:
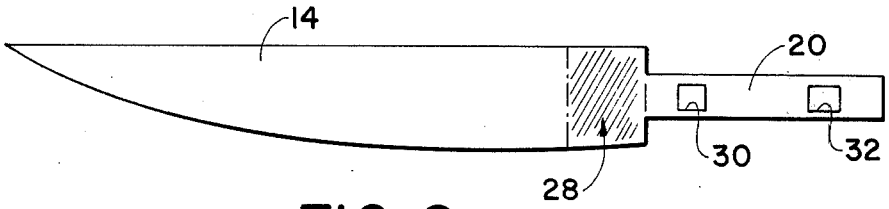
FIG. 2 is a side view in elevation of the blade of the preferred embodiment.

FIG. 2 illustrates the blade 14 and the tang 20 provided thereby. A portion 28 of the blade 14 adjacent to the tang 20 in unsharpened as a safety precaution so the user may easily grip the blade 14 when inserted and withdrawn from the handle element 12. A pair of rectangular holes 30 and 32 are located in the tang 20 and are coaxially aligned with the aperture 24 and 26 when the tang 20 is inserted in the handle element 12.

Figure 3:
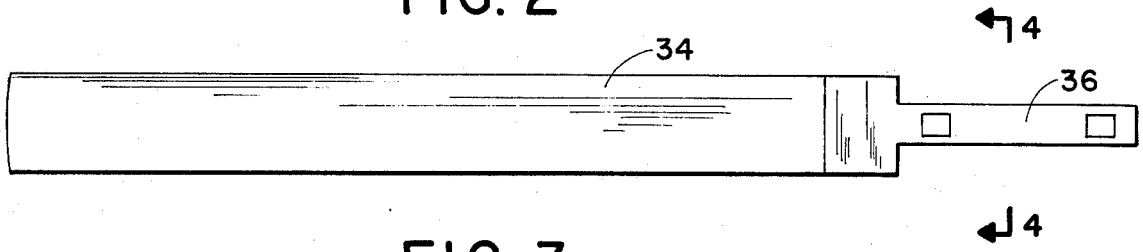
FIG. 3 is a side view in elevation of an alternate blade.

FIG. 3 illustrates an alternate blade 34 including a tang 36. The knife 10 may include any number of interchangeable blades in various sizes and shapes.

Figure 4:
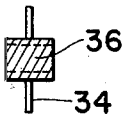
FIG. 4 is a cross-sectional of the blade of FIG. 3 taken substantially along the lines 4—4 thereof.

FIG. 4 illustrates a sectional view of the tang 36 provided by the blade 34. The tang 36 is preferably rectangular in shape as shown and in cooperation with a substantially rectangular elongated chamber 22 will prevent the blade from "wobble" when in use.

Figure 5:
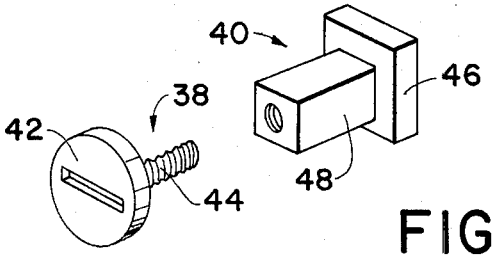
FIG. 5 is a perspective view of a bolt and nut element of the preferred embodiment.

FIG. 5 illustrates a bolt 38 and a nut element 40 of the present invention. The bolt provides a slotted head 42 and an externally threaded shank portion 44. The nut element 40 provides a substantially rectangularhead 46 and a substantially rectangular internally threaded shank portion 48. The internally threaded shank portion 48 is dimensioned to capture and threadably cooperate with the externally threaded shank portion 42 of the bolt 38.

Figure 6:
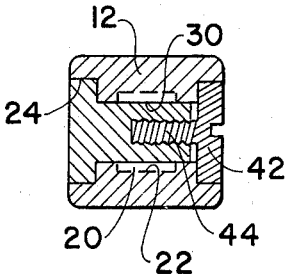
FIG. 6 is a cross-sectional view of the handle of FIG. 1 taken substantially along lines 5—5 thereof.

FIG. 6 illustrates the bolt 38 and the nut element 40 removably securing the tang 20 within the elongated chamber 22. The substantially rectangular shank portion 48 of the nut element 40 engages the aperture 24 of the handle element 12 and the hole 30 of the tang 20. Another bolt 38 and nut element 40 is similarly inserted through the aperture 26 of the handle element 12 and the hole 32 of the tang 20. The blades can be easily and quickly interchanged with the removal of the nut elements 40 and the bolts 38.

It will be understood that various changes in the details, materials, arrangements of parts and operation conditions which have been herein described and illustrated in order to explain the nature of the invention may be made by those skilled in the art within the principles and scope of the invention.

What is claimed is:

1. A knife having an interchangeable blade comprising:

an elongated rigid unitary handle element dimensioned to be held in a human hand, said elongated rigid unitary handle element having an elongated open-end chamber therein, the longitudinal axis of said chamber being substantially coaxial to the longitudinal axis of said handle element, said handle element having a plurality of apertures located therethrough, the longitudinal axis of said plurality of apertures being substantially transverse to said longitudinal axis of said chamber;

a sharpened knife blade providing a tang at one end thereof, said tang having a plurality of rectangular holes therethrough, the longitudinal axis of said plurality of holes being substantially perpendicular to the longitudinal axis of said knife blade, said tang dimensioned to be inserted in said open-end of said chamber and to be removably retained therein, said plurality of holes coaxially aligning with said plurality of apertures in said handle when said tang is inserted in said chamber; and bolt means for securing said tang within said chamber, said bolt means for insertion through said coaxially aligned holes and apertures, said bolt means including a plurality of bolts and nut elements, said bolts having a slotted head and an externally threaded shank portion, said nut elements having a head and an internally threaded shank portion, said internally threaded shank portion dimensioned to capture and threadably cooperate with said externally threaded shank portion, said shank portions of said pluarlity of nut elements have a substantially rectangular cross-section, said plurality of apertures falling adjacent said heads of said plurality of nut elements when inserted therein being rectangular in shape, said heads of said plurality of nut elements being correspondingly rectangular in shape.

2. A knife having an interchangeable blade as claimed in claim 1, wherein said chmaber and said tang have a substantially rectangular cross-section.

3. A knife having an interchangeable blade as claimed in claim 1, wherein the portion of said blade adjacent said tang is dulled.

* * * * *